United States Patent [19]

Muschelknautz et al.

[11] Patent Number: 4,871,147

[45] Date of Patent: Oct. 3, 1989

[54] APPARATUS FOR THE PYROMETALLURGICAL PROCESSING OF FINE-GRAINED SOLIDS

[75] Inventors: Edgar Muschelknautz, Stuttgart; Ernst Becker, Esslingen; Adalbert Bartsch, Marxen; Lars Kersten; Georg Gospos, both of Hamburg; Gerhard Berndt, Seevetal, all of Fed. Rep. of Germany

[73] Assignee: Norddeutsche Affinerie Aktiengesellschaft, Hamburg, Fed. Rep. of Germany

[21] Appl. No.: 70,105

[22] Filed: Jul. 2, 1987

Related U.S. Application Data

[63] Continuation of Ser. No. 834,738, Feb. 28, 1986, abandoned.

[30] Foreign Application Priority Data

Mar. 2, 1985 [DE] Fed. Rep. of Germany ..... 3507371

[51] Int. Cl.[4] ..... F27B 15/08

[52] U.S. Cl. ..... 266/182; 75/26; 110/244

[58] Field of Search ..... 266/182; 75/26; 110/244

[56] References Cited

U.S. PATENT DOCUMENTS 4,665,842 5/1987 Bartsch et al. ..... 110/265

FOREIGN PATENT DOCUMENTS 0193976 9/1986 European Pat. Off. .

*Primary Examiner*—Melvyn J. Andrews

*Attorney, Agent, or Firm*—Herbert Dubno

[57] ABSTRACT

An apparatus is described which serves for a pyrometallurgical processing of fine-grained solids suspended in high-oxygen gases, comprising a generally horizontally extending cylindrical vessel and a combustion shaft, which communicates with and vertically opens into the vessel which is provided with a gas outlet opening and with an opening for discharging molten material. An almost complete separation of the molten particles is effected in that the mouth of the combustion shaft tangentially opens into the vessel at the entrance of a spiral-shaped entrance passage, which opens into a discharge slot, which is formed in the shell of the vessel and which in the lower portion of the shell of the substantially cylindrical vessel extends substantially parallel to the longitudinal axis of the vessel.

8 Claims, 9 Drawing Sheets

PRIOR ART

APPARATUS FOR THE PYROMETALLURGICAL PROCESSING OF FINE-GRAINED SOLIDS

This is a continuation of co-pending application Ser. No. 834,738 filed on Feb 28, 1986 now abandoned.

FIELD OF THE INVENTION

Our present invention relates to an apparatus for the pyrometallurgical treatment of fine-grained solids to make a product which is molten at the processing temperatures.

BACKGROUND OF THE INVENTION

German Pat. No. 22 53 074 and the corresponding U.S. Pat. No. 3,915,692 disclose a method of pyrometallurgical processing of fine-grained solids to make products which are molten at processing temperatures.

In that process the solids, suspended in high-oxygen gases, are reacted in a vertical combustion path, in which they are moved at a high velocity to prevent backfiring.

The resulting suspension contains mainly molten particles and is fed into a horizontally extending cyclone chamber. Hot gas, which contains molten droplets, from the vertical cylindrical combustion path directly enters the horizontal cylindrical cyclone chamber at one end of the latter in a tangential direction and centrally leaves said cyclone chamber at its opposite end through a collar to enter a downstream secondary chamber.

The molten material which has been separated out from the gas in the cyclone flows out the exit end for the gas stream into the secondary chamber through a high narrow slot which is formed in the end wall in the vertical center plane thereof below the collar.

A melting cyclone chamber is used in a similar process in German Pat. No. 20 10 872 and the corresponding Canadian Pat. No. 926,631. That melting cyclone chamber has an approximately horizontal axis, which has a downward inclination not in excess of about 30° from the horizontal.

A separate combustion path is not employed and solids and preheated gas are blown into the cylindrical cyclone chamber from above along a secant. Charging is effected almost over the entire length of the cyclone. Through a collar, which has been centrally provided in the end wall, the gas flows into a secondary chamber. The molten material flows under the collar through a hole at the lowermost point of the end wall into the secondary chamber as well.

Depending upon the nature of the solids being processed, trouble frequently can arise during the operation of these cyclone chambers.

Operation at high throughput rates can result in strong incrustation at the gas outlet openings because there the molten material may not any longer be sufficiently separated from the gas.

OBJECTS OF THE INVENTION

It is an object of the invention to provide for the pyrometallurgical processing of fine-grained solids an apparatus, particularly a cyclone chamber, in which the disadvantages of known apparatus, particularly the disadvantages mentioned above, are avoided.

Another object of the invention is to provide an apparatus which more efficiently can effect pyrometallurgical processing of fine-grained solids and which, in particular, effects an improved separation of the molten droplets formed by the process from the gas.

SUMMARY OF THE INVENTION

An apparatus for the pyrometallurgical processing of fine-grained solids suspended in high-oxygen gases can comprise a generally horizontally extending cylindrical vessel and a combustion shaft, which communicates with and vertically opens into the vessel, which is provided with a gas outlet opening and with an opening for discharging molten material.

According to the invention, the aforestated objects are attained by providing the mouth of the combustion shaft so that it tangentially opens into the vessel at the entrance of a spiral-shaped entrance passage, which opens into a discharge slot communicating between a collecting container and the cylindrical vessel, which is formed in the shell of the vessel and which in the lower portion of the shell of the substantially cylindrical vessel extends substantially parallel to the longitudinal axis of the vessel, i.e. along a generatrix thereof.

In the operation of the apparatus in accordance with the invention the particles which have been subjected to a pyrometallurgical processing are virtually entirely separated from the gas phase (gas stream), particularly if the gas stream has a high loading $\mu=7$ kg molten particles per kg of gas.

We have found, surprisingly, that in the case of a high loading of the gas stream laden with molten particles and exiting from the combustion shaft, almost all molten particles are centrifuged against the container walls at the initial portion of the curved entrance passage so that a coherent, rapidly flowing film is immediately formed on the steep cylindrical wall in that region.

The high velocity of flow of the film decreases to a fractional part of this velocity as the inclination decreases in the lower portion of the cyclone wall.

In such an undesired case as we have found to prevail in earlier cyclones, a molten film tends to be retained in conventional cyclones and will form waves and part of the gas stream will be deflected by the waves or at the surface as by a baffle to flow directly toward the gas outlet.

That part of the stream which has been deflected upwardly over the surge then tends to tear numerous large drops out of the liquid wave in an undesired manner and owing to the dynamic pressure of the exiting gas stream, that wave exhibits a strong pulsation and turbulence.

The droplets which have been entrained rise slowly almost in a vertical direction into a vortex at the center of the stream in the cyclone. The vortex rotates and swings in a highly irregular manner, and in the vortex the entrained droplets are increasingly deflected in an axial direction toward the gas outlet.

Droplets which are accelerated and gyrate are also separated and are deposited in part on the internal surfaces at the gas outlet and in part are entrained by the stream and carried through the gas outlet (reference may be had to FIGS. 1 and 2 which represent such an earlier system.

By contrast, as we have found with the invention the molten particles are separated from the gas stream to form a film on the spiral wall virtually in the first curved portion of the spiral-shaped entrance passage and the separated particles are almost completely transferred into the discharge slot or slotlike discharge passage.

The molten material then flows as a jet through the discharge slot into the container for collecting the molten material. From the collecting container the molten material can be transferred into a forehearth, in which a separation of mixed molten material into its components may be effected.

Advantageously, an exhaust gas opening can be provided in the container for collecting the molten material so that a small part of the gas stream may be caused to escape through the the discharge slot and the container for collecting molten material.

The walls of the cyclone chamber can consist of tube walls, which are steam-cooled, provided with studs and lined with refractory material. Such walls are reliably protected by a thin solid layer formed in situ from the molten products of the process.

In the lower portion of the cyclone chamber the spiral-shaped entrance passage is defined by a flat inclined wall portion, which terminates in a tangential direction and is continued by the lower boundary surface of the discharge slot. That planar surface is downwardly inclined at an angle about 20 to 45 degrees (preferably 20° to 40°) from the horizontal. The other, upper or downstream boundary surface of the discharge slot adjoins the wall at a point which lies on the spiral surface that is interrupted by the discharge slot. This geometry has been found to be especially advantageous for prolonged continuous operation.

The discharge slot may be defined by generally parallel walls. Advantageously, however, at least one wall diverges from the axis of the discharge slot in the direction toward the container for collecting molten material.

The combustion shaft is generally circular in cross section. In the apparatus in accordance with the invention the combustion shaft opens tangentially into the cyclone chamber at a mouth which can preferably be elliptical in cross section. A mouth having a rectangular cross section is desirable in numerous cases.

From the entrance cross section, the width of the spiral-shaped entrance passage increases continuously until its width is approximately as large as the length of the discharge slot. The length of the discharge slot in the direction of the axis of the cyclone is up to about 3 times the width of the spiral shaped entrance passage at its inlet.

In a particularly advantageous construction a groove is formed in the lining of the shell of the cyclone at the lowermost point of the lining and begins adjacent to the gas outlet opening. That groove increases in depth toward the discharge slot and permits a return flow of the molten film that has been formed by the residual molten particles which have subsequently been separated from the main gas stream. The return flow groove begins at a point which is spaced from the discharge slot by about $\frac{1}{2}$ to $\frac{2}{3}$ of the diameter of the gas outlet opening and extends with increasing depth as far as the discharge slot. At the discharge slot, the groove has a width "B" of about $\frac{1}{4}$ to $\frac{1}{2}$ of the diameter of the gas outlet opening and depth "T" which is approximately as large as the width "B". This has been found to ensure a reliable separation of the last residual molten particles from the gas stream and a complete return of the separated molten material through the groove into the discharge slot.

According to a feature of the invention, a portion of the horizontally extending, cylindrical cyclone is angled upwardly, which means that a cylindrical portion of the cyclone can be angled upwardly in its entirety or only the lower half of its shell may be angled upwardly so that the cyclone has a portion in the shape of an asymmetrical frustum of a cone.

The longitudinal axis is angled upwardly by an angle $\alpha$ of about 15° to 30°, and the length of the angled portion of the cyclone is approximately as large as the length of the return groove provided in the lower portion of the shell of the cyclone.

Finally, the entire shell of the cyclone may conically taper toward the gas outlet adjacent to the angled longitudinal axis.

Numerous solids can be subjected to pyrometallurgical processing in the apparatus in accordance with the invention. The apparatus is particularly suitable for the processing of non-ferrous metal ore concentrates and sulfide ores but can also be used to process oxide iron ores or iron ore concentrates, possibly after a preliminary reduction treatment, and for the processing of intermediate metallurgical products.

BRIEF DESCRIPTION OF THE DRAWING

The above and other objects, features and advantages of the present invention will become more readily apparent from the following description, reference being made to the accompanying highly diagrammatic drawing in which.

SPECIFIC DESCRIPTION

Figure 1:
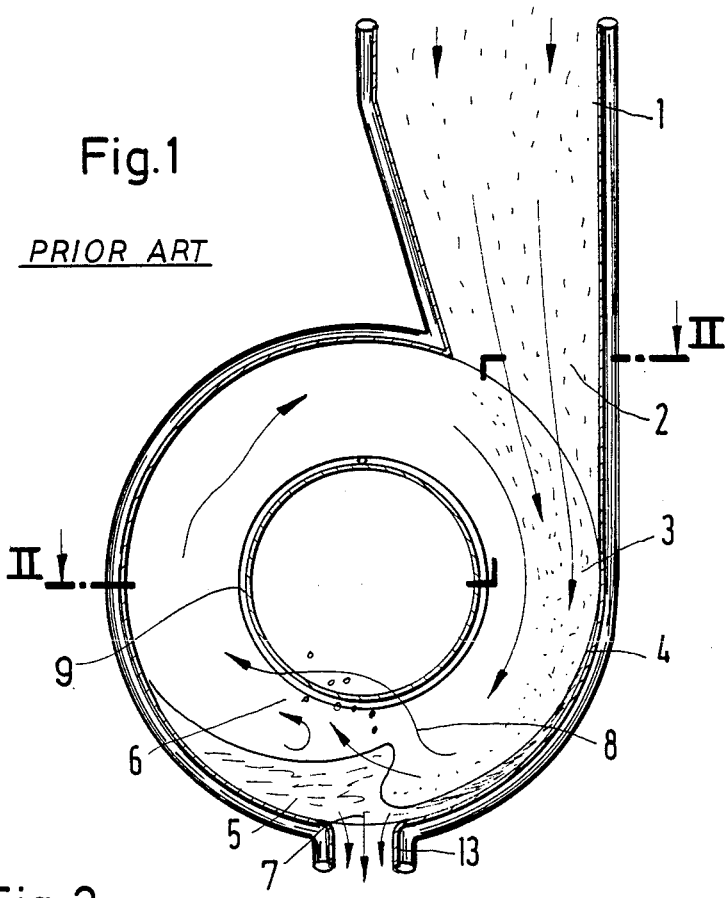
Fig.1 PRIOR ART
FIG. 1 is a sectional view showing a horizontally extending cyclone chamber of conventional type.
Figure 2:
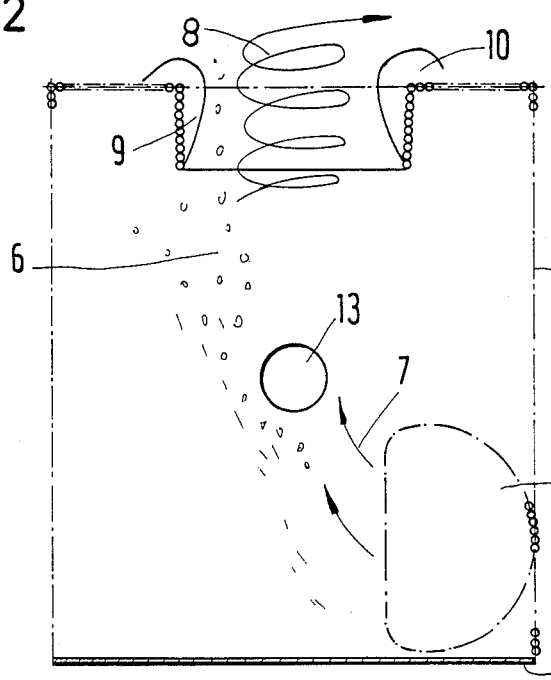
FIG. 2 is a longitudinal sectional view taken along section line II—II of FIG. 1.

A cyclone of convention type is illustrated in FIGS. 1 and 2. The combustion shaft 1 has a mouth 2. Droplets 3 are entrained by the hot gas and are separated in a film 4 formed on the wall. A surge 5 of the molten material can have large droplets 6 torn out of the surge in part by an axially deflected partial stream 7 and a radially deflected main stream 8. An outlet or collar 9 serves to discharge the gas but a deposit 10 can collect therein as described. The boiler tube wall 12 and the central outlet 13 for molten material have also been represented. In these Figures as in the Figures subsequently described, the walls are constituted by laterally contiguous tubes or turns of tubes forming passages for the steam.

Figure 3:
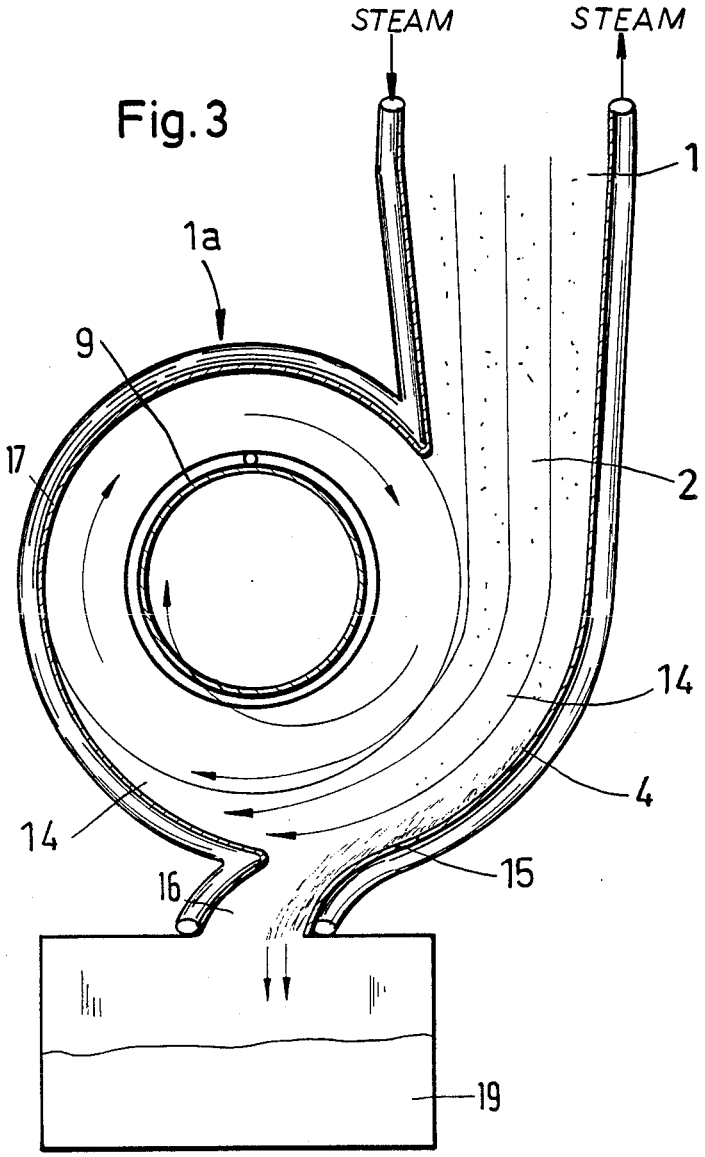
FIG. 3 is a sectional view showing a cyclone chamber in accordance with the present invention and a succeeding container for molten material.
Figure 3A:
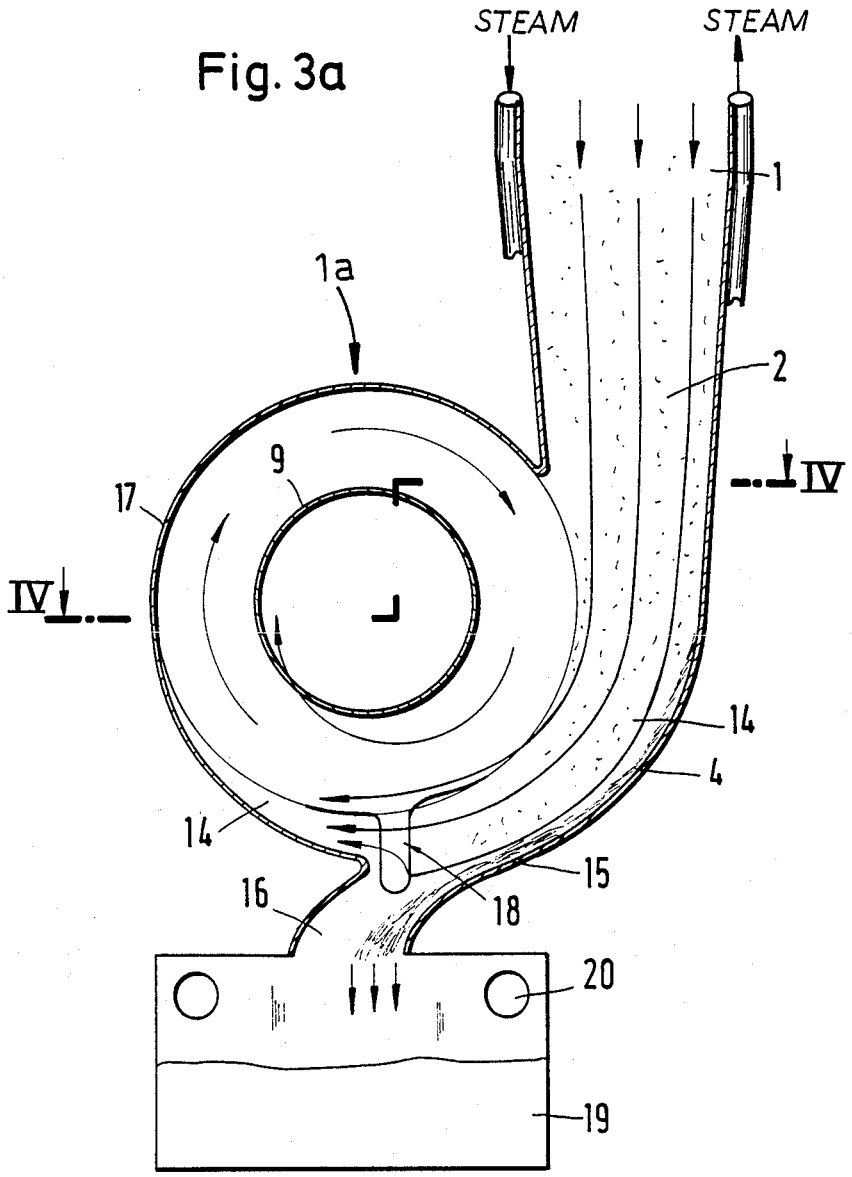
FIG. 3*a* is a sectional view that is similar to FIG. 3 but which also shows a return groove and openings leading to a secondary chamber.

FIGS. 3 and 3*a* show a cylindrical vessel 1a having a first end 30 and a second end 32 opposite one another, a combustion shaft 1 having a mouth 2, a gas outlet 9, an entrance passage 14 consisting of one-half of a convolution of a spiral, a quickly moving film 4 of molten material on a wall, an inclined plane surface 15 leading to the discharge slot 16, a boiler tube wall 17 of the cyclone, a return groove 18, a vessel 19 for collecting molten material, which vessel is formed with openings 20, and passages leading from these openings to the secondary chamber.

Figure 4:
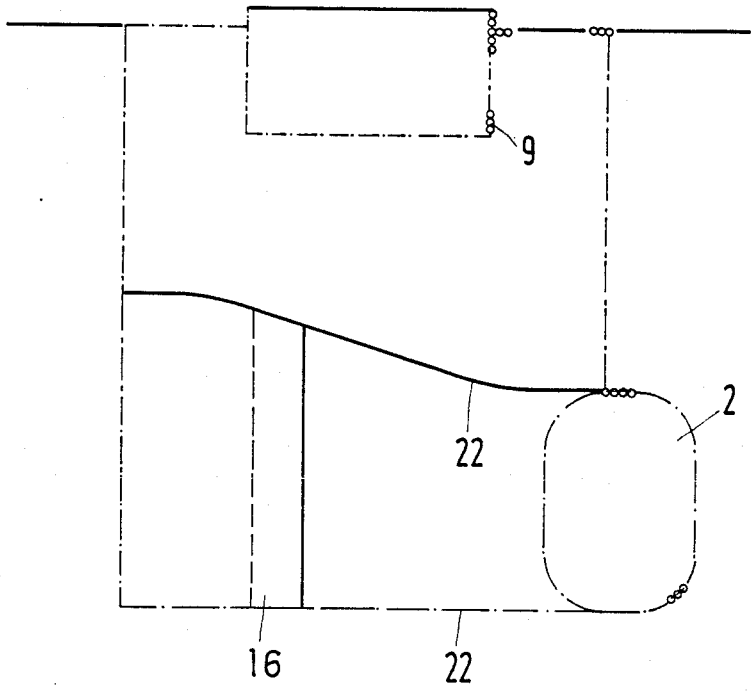
FIG. 4 is a longitudinal sectional view taken along line IV—IV of FIG. 3*a;*
Figure 4A:
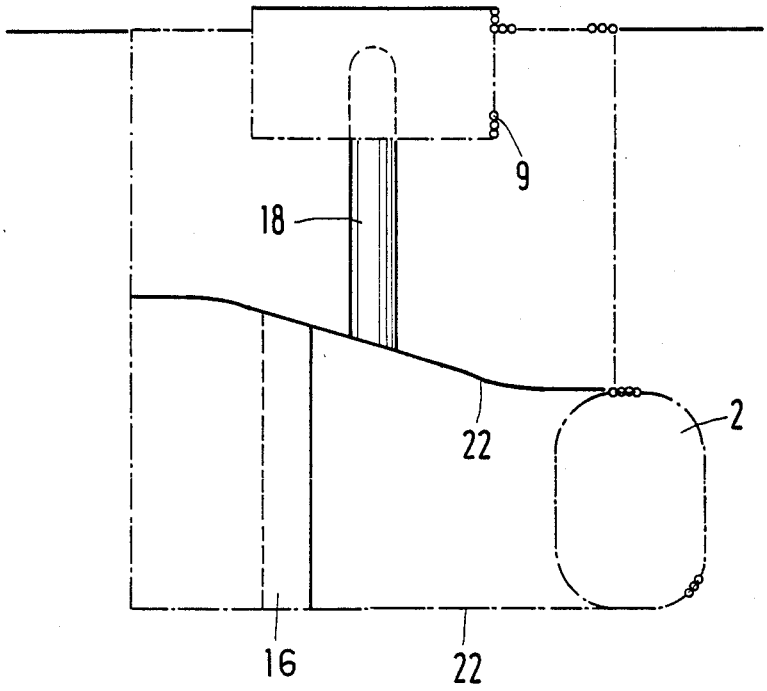
FIG. 4*a* is a sectional view that is similar to FIG. 4 but shows also the return groove.

FIG. 4 and 4*a* show the contour 22 of the spiral passage in a top plan view, which passage has a continously changing width. A return groove 18 is also seen in a top plan view. The apparatus also includes a mouth 2 of the combustion shaft, a gas outlet 9 and a boiler tube wall 17 of the cyclone.

Figure 5:
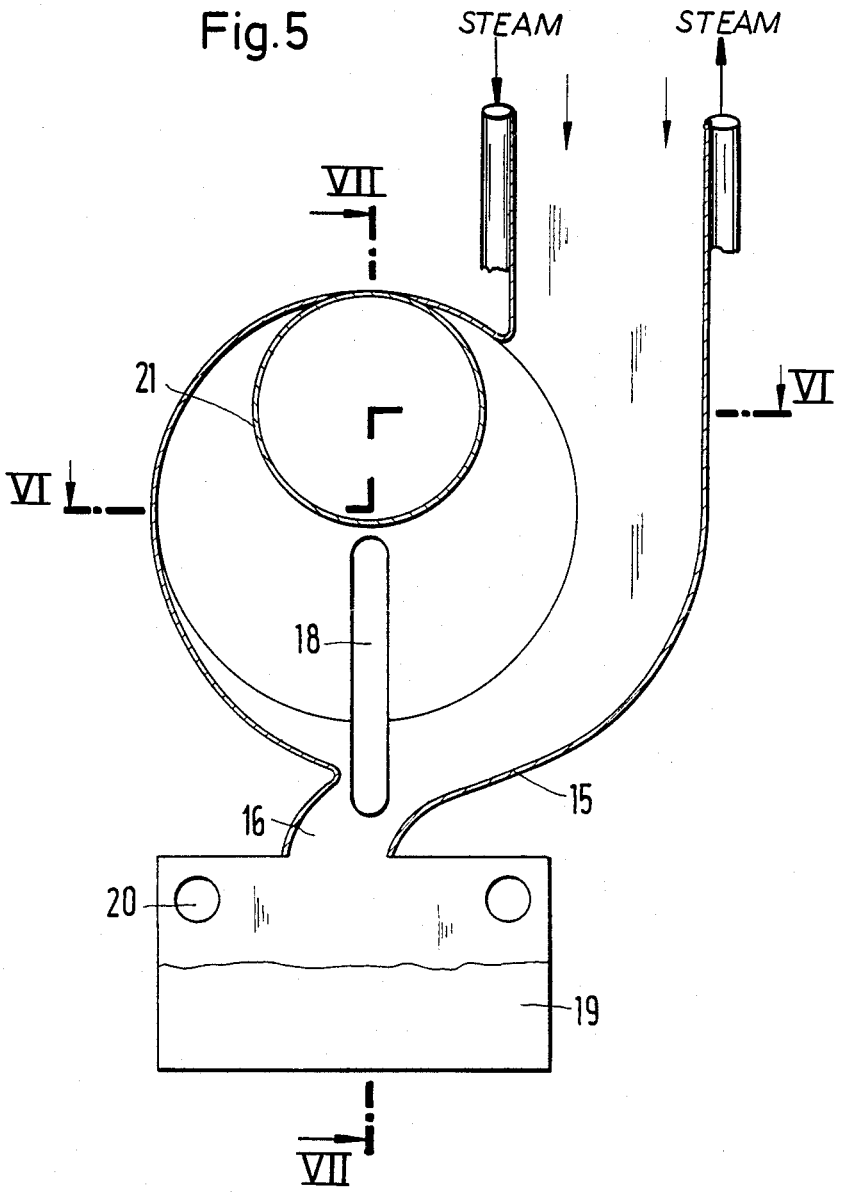
FIG. 5 is a sectional view showing a cyclone chamber having an angled longitudinal axis, viewed in the direction toward the gas outlet.

FIG. 5 shows a discharge slot 16, a planar wall portion 15 leading to the discharge slot 16, a gas outlet opening 21 at the end of the cyclone chamber, which tapers in the shape of an asymmetrical cone, a vessel 19, which receives the molten material and is formed with gas outlet openings 20, and a return groove 18.

Figure 6:
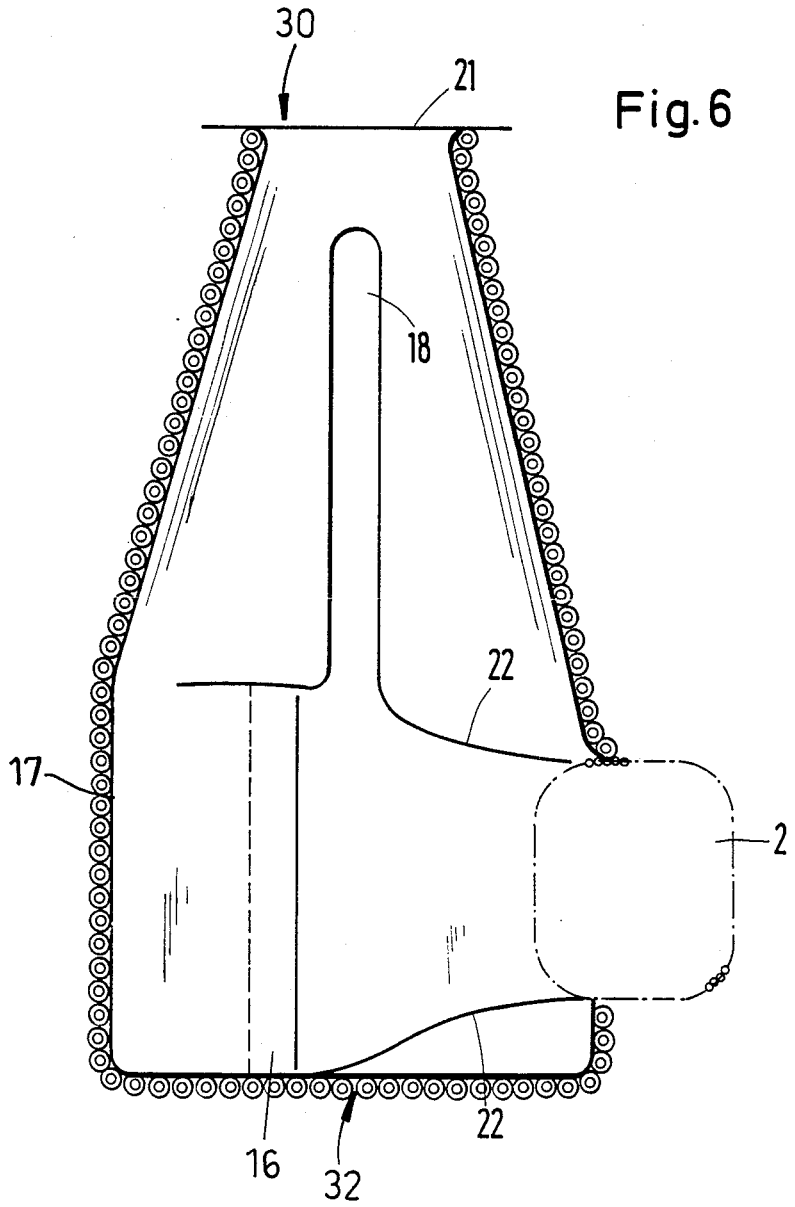
FIG. 6 is a longitudinal section taken along line VI—VI of FIG. 5.

FIG. 6 shows a gas outlet opening 21 at the end of the conical cyclone housing and the contours 22 of the spiral-shaped passage, which is enlarged in width on both sides and extends from the mouth 2 of the combustion shaft and in that direction is enlarged in width on both sides. The boiler tube wall 17 and the return groove 18 are also seen in this FIG.

Figure 7:
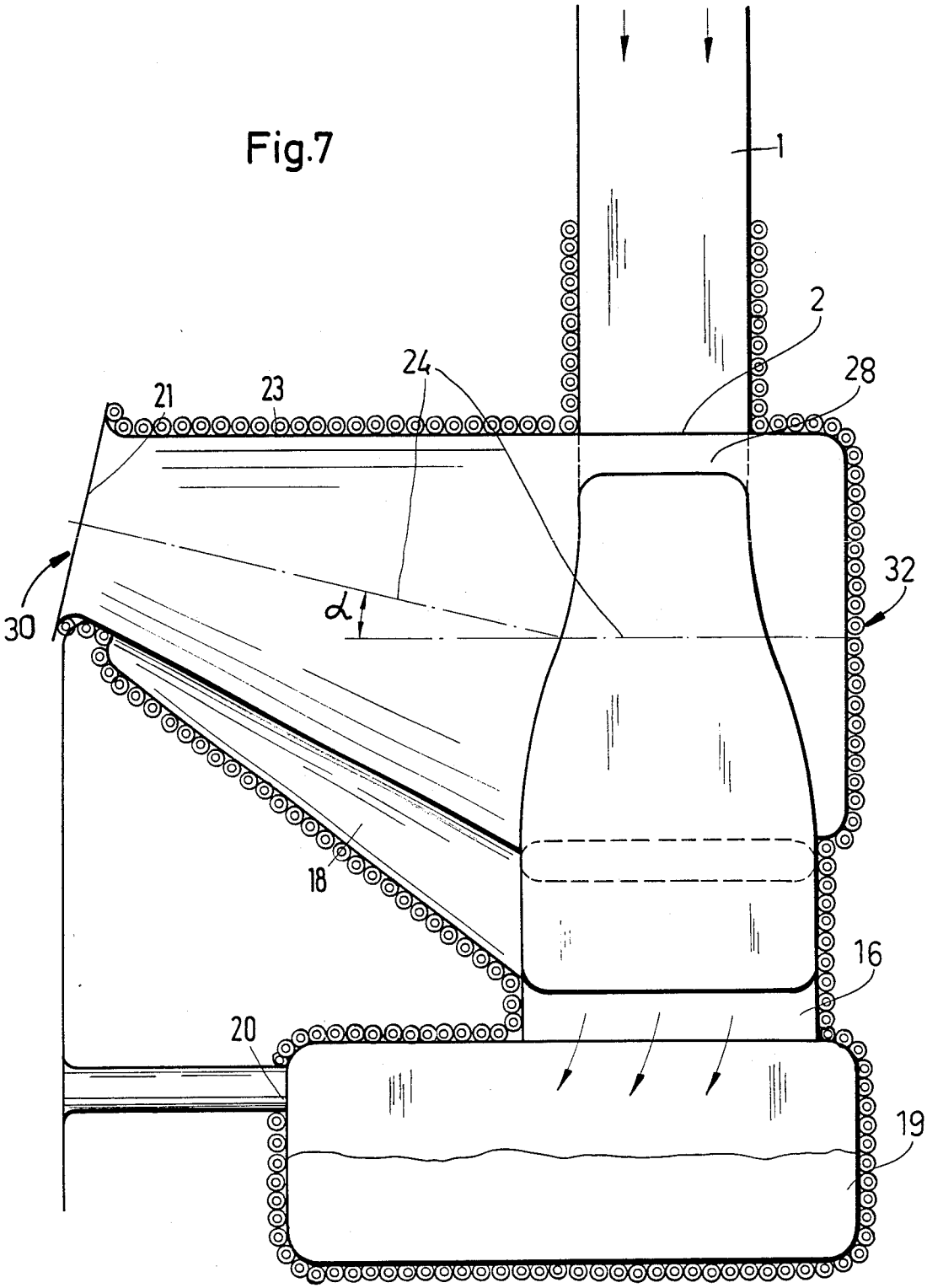
FIG. 7 is a longitudinal section taken along line VII—VII of FIG. 5.

FIG. 7 shows the cyclone axis 24, which is angled (at an angle $\alpha$), a portion 23 of the cyclone chamber, which portion tapers in the shape of an asymmetric cone, a gas outlet 20 of the vessel for molten material, a gas outlet 21 for the main gas stream, and the return groove 18.

Figure 8:
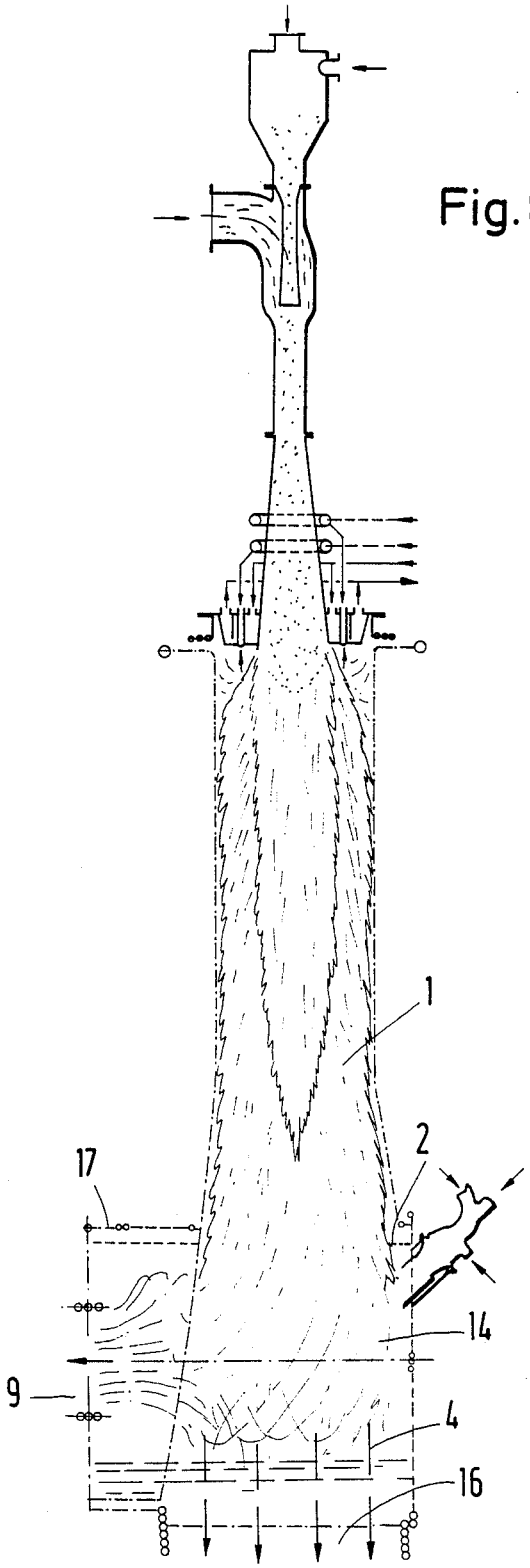
FIG. 8 is a sectional view showing a combustion shaft which opens into the cyclone by a structure in accordance with the invention.

FIG. 8 is a sectional view showing a combustion shaft 1 provided with burners and having a mouth 2. The combustion shaft opens into the cyclone in accordance with the invention. From the discharge slot 16 the molten material 4 emerges on the wall of the passage 14 consisting of one-half of a convolution of a spiral. The boiler tube wall of the cyclone is designated 17 and the gas outlet is designated 9.

In the following Example the apparatus in accordance with the invention will be explained in greater detail and by way of example with reference to its use for processing fine-grained solids, which form molten products at temperature used for pyrometallurgical processing.

SPECIFIC EXAMPLE

The burner shown in FIG. 8 is supplied from preceding bin, drying, proportioning and mixing plants with a complex copper ore concentrate having the composition stated hereinafter. That copper ore concentrate is supplied to the burner at a rate of 7000 kg/h in a pneumatic conveyor pipeline together with primary air supplied as an entraining gas at a rate of 380 to 390 $m^3/h$ (STP).

The ore concentrate had the following composition (by weight)

| | |
|---|---|
| Cu | 21–23% |
| Fe | 22–25% |
| S | 30–33% |
| Zn | 9–11% |
| Pb | 6–8% |
| $SiO_2$ | 1% |

and a particle size between 0.5 and 100 $\mu$m and 53% consisted of particles between 15 and 100 $\mu$m. Its residual moisture content was 0.1 to 0.3% by weight.

A slag-forming agent consisting of $SiO_2$ in the form of sand was supplied at a rate of 1300 kg/h to the concentrate-laden air stream before it enters the burner so that the iron oxide which is formed is incorporated in a slag. The sand used for that purpose has a residual moisture contant of 0.1% by weight and a particle size up to 0.7 mm.

The primary fluid stream consisting of 7000 kg/h concentrate, 1300 kg/h sand and 380 to 390 $m^3/h$ (STP) entraining air is mixed with a mixed secondary stream composed of 600 $m^3/h$ (STP) air and 1800 $m^3/h$ (STP) oxygen.

A homogenized and turbulence-free fluid jet is injected into the vertical burner shaft and is then ignited (German patent document No. 34 36 624).

As the reaction proceeds, the temperature rises quickly and at the end of the cylindrical portion of the burner shaft 1 reaches a maximum of about 160° C. (FIG. 8). The gas stream laden with molten particles is tangentially introduced into the cyclone at the entrance of the spiral-shaped entrance passage 14 (FIG. 3). The molten particles are separated from the gas stream on the spiral-shaped wall 4 in a vertical direction in the first portion of the spiral-shaped passage and are transferred almost entirely into the discharge slot 16. From the discharging slot 16, a jet of molten material enters a vessel 19 for collecting molten material.

The walls of the cyclone chamber consist in known manner of steam-cooled tube walls, which are provided with studs and with a refractory lining. The walls are reliably protected by the formation of a thin layer of solidified molten material which has been previously separated from the gas.

In the present example the process is thermally self-sufficient. In a processing of mixtures which generate less reaction heat, additional fuel is supplied in a gaseous, liquid or solid form.

The reaction heat which is dissipated through the cooled walls of the reactor plant is used to generate about 1000 kilograms of steam at 60 bars per 1000 kilograms of concentrate The following molten products are withdrawn from the cyclone vessel: Copper matte containing by weight

| | |
|---|---|
| Cu | 74% |
| Pb | 2.2% |
| Fe | 1.8% |
| S | 21.7% |
| Zn | 0.6% |

Slag containing by weight

| | |
|---|---|
| Cu | 1.8% |
| Pb | 1.8% |
| Zn | 9.3% |
| Fe | 35.8% |
| $SiO_2$ | 28.8% |

Copper matte and slag are jointly withdrawn from the discharge slot of the horizontal cyclone vessel as molten material at a temperature of about 1320° C.

Exhaust gas leaves the cyclone vessel in an axial direction (FIG. 3 at 9) at a temperature of 1320° C. containing about 56 vol. % $SO_2$.

An oxide- and sulfate-containing fine dust having the following composition by weight is entrained by the exhaust gas:

| | |
|---|---|
| Cu | 2.3% |
| Pb | 22.0% |
| Zn | 26.0% |
| S | 14% |
| Fe | 2% |

That fine dust is collected in waste heat boiler and gas-purifying plants which follow the cyclone plant.

The fact that the cyclone is superior in operation to cyclones of conventional type, having no discharge slot, is apparent from the following comparison of metallurgical data obtained in the processing described hereinbefore.

| | | Cyclone of conventional type without a discharge slot(+) | | Cyclone in accordance with the invention with a discharge slot | |
|---|---|---|---|---|---|
| | | Feed | % of discharged product | Feed | % of discharged product |
| Concentrate | wt % Cu | 22.3 | | 22.0 | |
| | wt % Fe | 23.5 | | 25.0 | |
| | wt % Pb | 6.3 | | 6.4 | |
| | Wt % Zn | 9.3 | | 10.5 | |
| Molten products | | | | | |
| Matte | wt % Cu | 75 | 83 | 74 | 90.5 |
| | wt % Pb | 2.6 | 10 | 2.2 | 8.8 |
| | wt % Zn | 0.2 | 0.5 | 0.6 | 1.4 |
| Slag | wt % Cu | 2.1 | 5 | 1.8 | 5.5 |
| | wt % Pb | 2.4 | 21 | 1.8 | 18.4 |
| | wt % Zn | 8.4 | 9.3 | 52.2 | |
| | | 48 | | | |
| Fine dust | wt % Cu | 7.0 | 12 | 2.3 | 4.0 |
| | wt % Pb | 16.7 | 69 | 22.0 | 72.8 |
| | wt % Zn | 21.7 | 51.5 | 26.0 | 46.4 |

(+)Conventional cyclone in accordance with German patent 22 53 074 and U.S. Pat. No. 3,915,692

We claim:

1. An apparatus for a pyrometallurgical processing of fine-grained solids suspended in high-oxygen gas, comprising:

a cylindrical vessel generally extending in a horizontal direction and having a longitudinal axis also extending in said horizontal direction, said vessel having a wall forming said vessel, said vessel having a first and a second end, said ends being opposite each other;

means to allow said high-oxygen gas to escape which means are defined by a circular gas outlet opening in said wall at said first end;

means for discharging molten particles of said fine-grained solids which means are defined by an elongate discharge slot in said wall adjacent said second end and extending for a length substantially parallel to said axis;

means to convey molten particles of said suspended fine-grained solids to said slot, and means being on said vessel and defining a spiral-shaped passage in said wall at said second end, and said elongate discharge slot positioned directly beneath said passage; and a combustion shaft vertically mounted on said vessel and having a mouth opening tangentially into said passage, said mouth defining a bottom of said shaft.

2. The apparatus defined in claim 1 wherein said passage has a widening cross-section between said mouth and said discharge slot and said discharge slot has a length substantially equal to a width of a cross-section of said spiral-shaped entrance passage.

3. The apparatus defined in claim 1 wherein said mouth at which the combustion shaft tangentially opens into the entrance passage is substantially elliptical in cross section.

4. The apparatus defined in claim 1 wherein the width of said spiral-shaped entrance passage increase continuously from said mouth to a width which is equal to the length of said discharge slot and said length is up to about three times the width of said spiral passage at said mouth.

5. The apparatus defined in claim 1 wherein said wall of said vessel is further provided with a return groove for returning molten material to said discharge slot, and said groove extends from said outlet opening to said discharge slot and increases at least in depth from said outlet opening to said discharge slot.

6. The apparatus defined in claim 5 wherein said return groove extends from a distance from said discharge slot equal to $\frac{1}{2}$ to $\frac{2}{3}$ of a diameter of said gas outlet opening and terminates at said discharge slot and said groove has at its termination a width of about $\frac{1}{4}$ to $\frac{1}{2}$ the diameter of the gas outlet opening and a depth which is approximately as large as the width.

7. The apparatus defined in claim 5 wherein said vessel over a length which is approximately as large as the length of said return groove has the longitudinal axis of the vessel at an angle to the horizontal of about 15 to 30 degrees.

8. The apparatus defined in claim 5 wherein a portion of said wall of said vessel formed with said return groove is tapered toward said gs outlet opening, whereby said vessel has a shape of an asymmetrical cone.

* * * * *